United States Patent [19]

Holmes

[11] 4,440,227

[45] Apr. 3, 1984

[54] WELL COMPLETION FOR INJECTING HIGH PURITY OXYGEN IN A FIRE FLOODING PROCESS

[75] Inventor: Billy G. Holmes, Lancaster, Tex.

[73] Assignee: Mobil Oil Corporation, New York, N.Y.

[21] Appl. No.: 439,661

[22] Filed: Nov. 8, 1982

[51] Int. Cl.[3] ..... E21B 43/243

[52] U.S. Cl. ..... 166/261; 166/77

[58] Field of Search ..... 166/261, 260, 59, 77, 166/373, 244 C, 242, 251

[56] References Cited

U.S. PATENT DOCUMENTS

| | | | |
|---|---|---|---|
| 2,584,606 | 2/1952 | Merriam et al. | 166/59 X |
| 2,994,375 | 8/1961 | Hurley | 166/261 X |
| 3,135,324 | 6/1964 | Marx | 166/251 |
| 3,240,270 | 3/1966 | Marx | 166/256 X |
| 3,284,137 | 11/1966 | Wolber | 166/59 X |
| 3,658,270 | 4/1972 | Slator et al. | 166/77 |
| 4,031,956 | 6/1977 | Terry | 166/261 |
| 4,042,026 | 8/1977 | Pusch | 166/258 |

*Primary Examiner*—Stephen J. Novosad

*Attorney, Agent, or Firm*—Alexander J. McKillop; Michael G. Gilman; Lawrence O. Miller

[57] ABSTRACT

A well completion for an injection well includes continuous tubing disposed within a tubing string. Oxygen is supplied to a fire flood process through the continuous tubing and water is supplied through the tubing string. The tubing string and continuous tubing are valved and seated in a manner which provides for safe injection of high purity oxygen into the subsurface formation.

18 Claims, 1 Drawing Figure

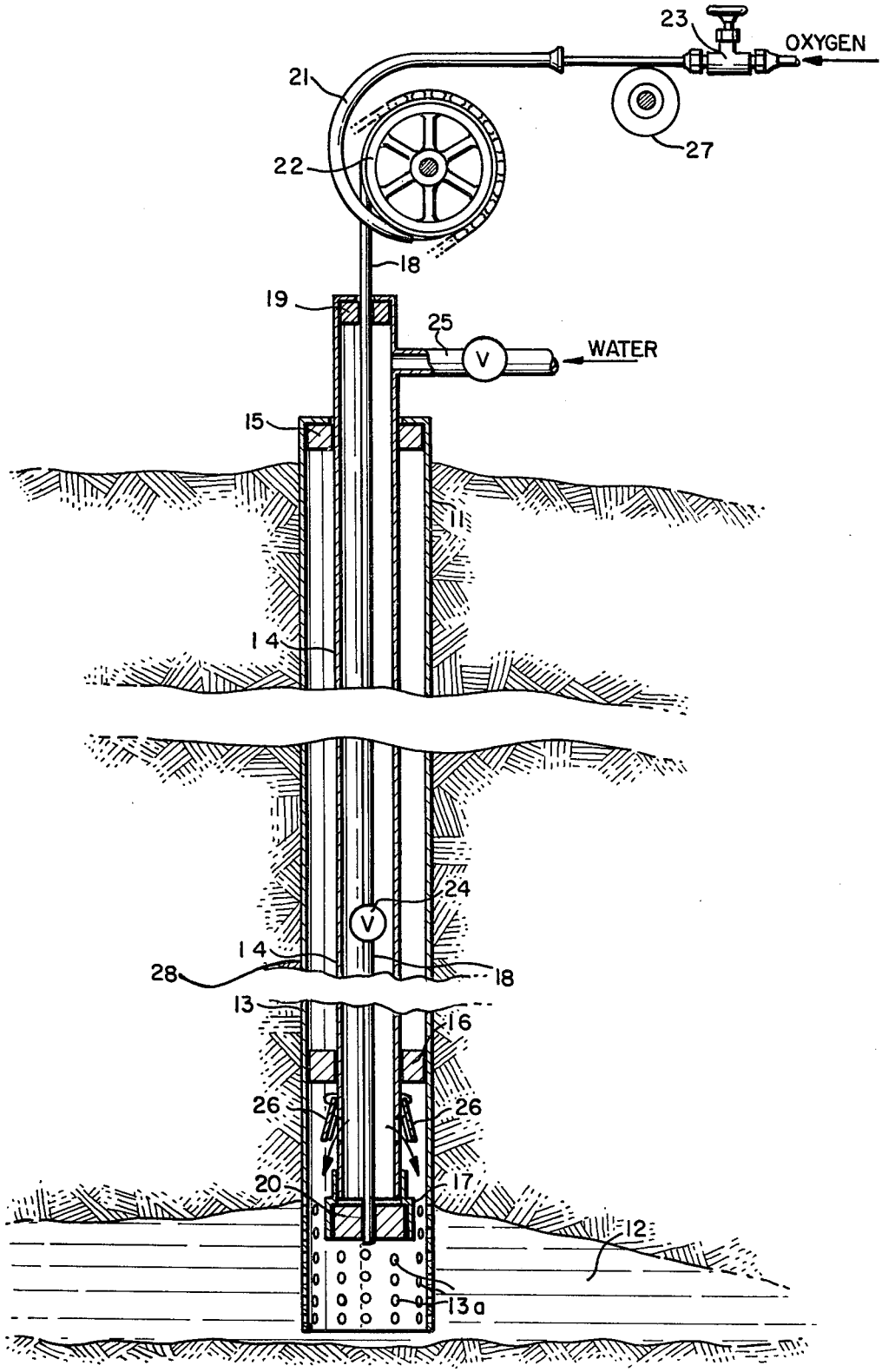
23
OXYGEN
21
27
22
18
19
25
V
WATER
15
11
14
24
V
14
28
18
13
16
26
26
20
17
12
13a

WELL COMPLETION FOR INJECTING HIGH PURITY OXYGEN IN A FIRE FLOODING PROCESS

BACKGROUND OF THE INVENTION

This invention relates to the in-situ combustion of hydrocarbons in a subsurface formation and more particularly, to an improved well completion which permits the safe injection of high purity oxygen into a well.

In-situ combustion for the recovery of hydrocarbons from subsurface formations is becoming increasingly prevalent. Combustion is initiated in the subsurface formation and the resulting combustion zone moves through the formation by the injection of air or oxygen. By carefully controlling the injection of oxygen and water into the formation, the combustion zone progresses in a manner which facilitates the recovery of hydrocarbons from the formations. U.S. Pat. Nos. 3,240,270—Marx, 4,031,956—Terry, and 4,042,026—Pusch, et al are examples of the recovery of hydrocarbons by in-situ combustion.

In such processes, the prevention of unintended ignition is of primary concern. For example, as the combustion zone expands away from the injection well, a large volume of unreacted oxygen sometimes accumulates near the well. If this travels upwardly in the well, a catastrophic fire possibly destroying the well, can be ignited. U.S. Pat. No. 3,135,324—Marx discusses the ignition problem.

The use of oxygen in such fire flooding processing has been limited because of the stringent requirement that the oxygen be supplied through a clean pipe. Contamination which is normally found in well tubing strings is a severe fire hazard in the presence of oxygen. A typical oxygen driven fire flood operation alternately supplies water and oxygen through the same tubing string to the formation. Coatings which are normally applied to tubing strings which convey water cannot be used because they react with the oxygen. On the other hand, using stainless steel tubing strings of sufficient diameter to conduct water would be prohibitively expensive.

It is an object of the present invention to provide a well completion which can be safely used in an oxygen driven fire flooding process.

It is a further object of the present invention to provide a fire flooding process which can be conventionally ignited with air and, thereafter, converted to an oxygen driven fire flood.

SUMMARY OF THE INVENTION

In accordance with the present invention, coiled, continuous, stainless steel tubing is run within the tubing string in an injection well. Oxygen is supplied to the formation through the continuous tubing and water is supplied to the formation through the tubing string. The coiled, continuous, stainless steel tubing has the advantage of cleanliness. It can be transported to the site, and run into the well in a manner which maintains its condition of cleanliness. Because of this, oxygen can be supplied to the formation without contacting the contamination which is normally present in any well completion. Water is supplied to the formation through the tubing string which provides an inexpensive way of supplying large amounts of water to the formation.

The continuous tubing is seated in a fitting at the bottom of the tubing string. A packing gland at the top of the tubing string seats the continuous tubing so that good separation of the water and oxygen supply within the well is maintained.

Further in accordance with the present invention, check valves are provided in a manner which prevents the flow of unreacted oxygen up through the well, thereby obviating a potential fire hazard.

Further in accordance with the present invention, ignition of the fire flood can be obtained with air in a conventional ignition process. Thereafter, the continuous tubing string can be run into the well to convert it into an oxygen injection well.

The foregoing and other objects, features and advantages of the invention will be better understood from the following more detailed description and appended claims.

SHORT DESCRIPTION OF THE DRAWING

The drawing shows a completion for an oxygen injection well in accordance with the present invention.

DESCRIPTION OF THE PREFERRED EMBODIMENT

Referring to the drawing, an injection well 11 is shown in a field in which hydrocarbons are to be recovered from a formation 12 in an in-situ combustion process. Commonly, well 11 is an old producing well. Typically, it has a carbon steel casing 13 which is perforated at 13*a* to allow production from the formation.

A tubing string 14 is disposed within the well. A packing gland 15 and a packer 16 seat the tubing string in the well. Typically, tubing string 14 may be of the type made up of sections joined together by tubing collars. Such tubing strings are commonly disposed within a well to suspend a pump from the bottom. Tubing string 14 has at the bottom thereof a fitting 17, which may be of the type having a female opening into which a pump is normally secured.

In accordance with the present invention, coiled, continuous, tubing 18 is disposed within the tubing string 14. A packing gland 19 seats the continuous tubing in the tubing string at the top thereof. At the bottom, the continuous tubing has a male fitting 20 which seats the continuous tubing 18 in the tubing string 14.

Continuous tubing 18 is typically $\frac{3}{4}''$ or 1" stainless steel, or other alloy, tubing which is dispensed from a reel 27. The tubing is driven through a guide 21 by drive wheel 22. Mechanisms for running coiled, continuous tubing into a well are described more fully in "A SMALL, COILED-TUBING WORKOVER RIG", by J. L. Rike, presented at 27th annual meeting, American Association of Oil Well Drilling Contractors, Oklahoma City, Okla., Oct. 11-13, 1967.

A source of oxygen is connected through remote valve 23 to the continuous tubing 18. A check valve 24 near the bottom of continuous tubing 18 prevents backflow of unreacted oxygen up the tubing 18. The oxygen, in controlled amounts, enters the formation through the perforations 13*a* in the casing 13.

In order to control the fire flooding, water is injected into the well through an annulus 25 connected to the tubing string 14. The water flows through the tubing string 14 and out through the check valve 26 near the bottom of the tubing string.

There is water between the well casing 13 and the tubing string 14 between the packing glands 15 and 16. This ensures that fire will not travel up the well between the casing and the tubing string. Fire breaks indicated at 28 provide further fire prevention.

While a particular embodiment of the invention has been shown and described, various modifications are within the true spirit and scope of the invention. The appended claims are, therefore, intended to cover all such modifications.

What is claimed is:

1. A well completion for an injection well in a field in which hydrocarbons are recovered by in-situ combustion in a subsurface formation comprising:

a casing extending the length of said well and containing passages to provide fluid communication with the formation;

a tubing string disposed within said casing;

means for seating said tubing string in said casing;

continuous tubing disposed within said tubing string;

means for seating said continuous tubing in said tubing string;

means for supplying water to said tubing string;

means for supplying oxygen to said continuous tubing; and a check valve near the bottom of said continuous tubing to allow oxygen to enter said formation through said continuous tubing and to prevent unreacted oxygen in said formation from traveling up said continuous tubing.

2. The well completion recited in claim 1 wherein said continuous tubing is flexible and is coiled on a reel before insertion in said well.

3. The well completion recited in claim 1 wherein said continuous tubing is corrosion resistant stainless steel.

4. The well completion recited in claim 1 wherein said means for seating said tubing string includes packing glands between said tubing string and the casing of said well at the top and bottom thereof, and forming a seal between said casing and said tubing string so that water can be contained between said casing and said tubing string between said packing glands.

5. A well completion for an injection well in a field in which hydrocarbons are recovered by in-situ combustion in a subsurface formation comprising:

a casing extending the length of said well and containing passages to provide fluid communication with the formation;

a tubing string disposed within said casing;

means for seating said tubing string in said well;

continuous tubing disposed within said tubing string;

means for seating said continuous tubing in said tubing string;

means for supplying water to said tubing string;

means for supplying oxygen to said continuous tubing; and a check valve near the bottom of said tubing string to allow water to enter said formation through said tubing string and to prevent unreacted oxygen in said formation from traveling up said tubing string.

6. The well completion recited in claim 5 wherein said continuous tubing is flexible and is coiled on a reel before insertion in said well.

7. The well completion recited in claim 5 wherein said continuous tubing is corrosion resistant stainless steel.

8. The well completion recited in claim 5 wherein said means for seating said tubing string includes packing glands between said tubing string and the casing of said well at the top and bottom thereof, and forming a seal between said casing and said tubing string so that water can be contained between said casing and said tubing string between said packing glands.

9. A well completion for an injection well in a field in which hydrocarbons are recovered by in-situ combustion in a subsurface formation comprising:

a casing extending the length of said well and containing passages to provide fluid communication with the formation;

a tubing string disposed within said casing;

means for seating said tubing string in said well;

continuous tubing disposed within said tubing string;

means for seating said continuous tubing comprising a packing gland at the top of said tubing string and a fitting at the bottom of said tubing string, said continuous tubing being inserted into an opening in said fitting;

means for supplying water to said tubing string; and means for supplying oxygen to said continuous tubing.

10. The well completion recited in claim 9 wherein said continuous tubing is flexible and is coiled on a reel before insertion in said well.

11. The well completion recited in claim 9 wherein said continuous tubing is corrosion resistant stainless steel.

12. The well completion recited in claim 9 wherein said means for seating said tubing string includes packing glands between said tubing string and the casing of said well at the top and bottom thereof, and forming a seal between said casing and said tubing string so that water can be contained between said casing and said tubing string between said packing glands.

13. The method of establishing a combustion zone from an injection well in a field in which hydrocarbons are recovered by in-situ combustion in a subsurface formation comprising:

disposing a tubing string within said well and into said formation;

seating continuous tubing within said tubing string so that the bottom of said continuous tubing is in proximity to said formation;

supplying water to said formation through said tubing string;

supplying oxygen to said formation through said continuous tubing;

supplying oxygen to said formation through a check valve in said continuous tubing to prevent unreacted oxygen in said formation from traveling up said continuous tubing.

14. The method recited in claim 13 further comprising:

sealing the opening between said tubing string and said continuous tubing at the bottom thereof; and supplying water to said formation through a check valve in said tubing string near the bottom thereof which allows water to enter said formation and prevents unreacted oxygen in said formation from traveling up said tubing string.

15. The method recited in claim 13 wherein said combustion zone is ignited, and said continuous tubing is thereafter run in said well so that oxygen can be supplied to said formation.

16. The well completion recited in claim 13 wherein said continuous tubing is flexible and is coiled on a reel before insertion in said well.

17. The well completion recited in claim 13 wherein said continuous tubing is corrosion resistant stainless steel.

18. The well completion recited in claim 13 wherein said means for seating said tubing string includes packing glands between said tubing string and the casing of said well at the top and bottom thereof, and forming a seal between said casing and said tubing string so that water can be contained between said casing and said tubing string between said packing glands.

* * * * *